US005556057A

United States Patent [19]

Davies

[11] Patent Number: 5,556,057

[45] Date of Patent: Sep. 17, 1996

[54] VARIABLE GEOMETRY KITE

[76] Inventor: David V. Davies, 36 Lawrence Drive, Ickenham, Middlesex UB10 8RW, United Kingdom

[21] Appl. No.: 413,595

[22] Filed: Mar. 30, 1995

[30] Foreign Application Priority Data

Apr. 27, 1993 [GB] United Kingdom ..... 9308686
Mar. 14, 1994 [GB] United Kingdom ..... 9404893

[51] Int. Cl.[6] ..... B64C 31/06

[52] U.S. Cl. ..... 244/153 R; 244/154; 244/155 R; 244/155 A

[58] Field of Search ..... 446/489; 273/58 C; 244/153 R, 154, 155 R, 155 A

[56] References Cited

U.S. PATENT DOCUMENTS 4,103,453 8/1978 Baron .
4,871,133 10/1989 Alonso ..... 244/153 R
4,892,272 1/1990 Hadzicki .
4,942,506 7/1990 Flory ..... 244/155 R
4,981,273 1/1991 Petteys .
5,149,021 9/1992 Prouty ..... 244/153 R
5,152,481 10/1992 Cote et al. ..... 244/155 R
5,251,854 10/1993 Iwamoto .

FOREIGN PATENT DOCUMENTS 1438197 6/1976 United Kingdom .
2277696 11/1994 United Kingdom .

*Primary Examiner*—Andres Kashnikow
*Assistant Examiner*—Tien Dinh
*Attorney, Agent, or Firm*—Richard P. Crowley

[57] ABSTRACT

A controllable kite, which changes its geometry and aerodynamic form in flight, in response to control inputs from control handles and control lines, enabling smooth stable high-speed flight as well as extreme low-speed agility and the ability to fly in any direction or hover, consists of a flexible leading-edge spar, stressed by the curve of the sail and providing tension in the sail. Control longerons, at a predetermined angle on either side of the centerline act on the leading-edge spar in such a way as to provide variable geometry that controls the form, stability and flying characteristics of the kite and sustains the shape required for both high and low-speed flight. Precise control is achieved by attaching equal-length control lines from control handles directly to the control longerons without the need for bridling.

21 Claims, 8 Drawing Sheets

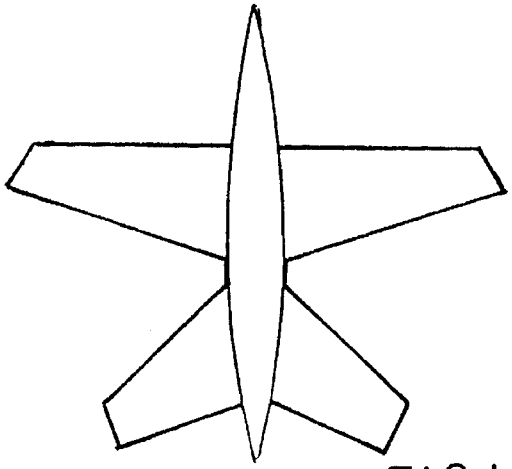
PRIOR ART FIG. 1
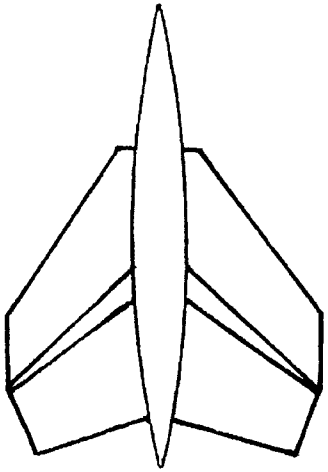
PRIOR ART FIG. 2
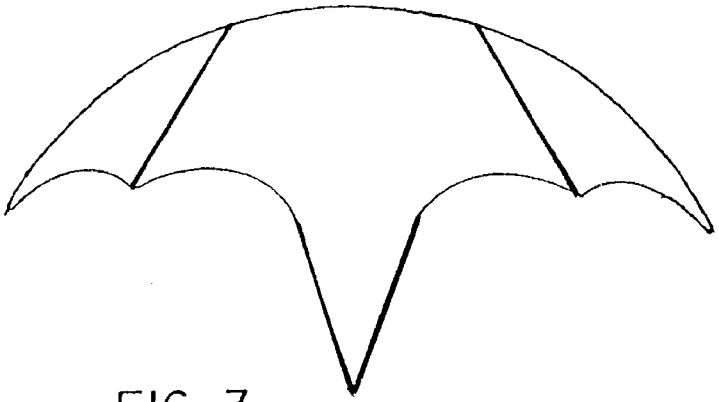
FIG. 3
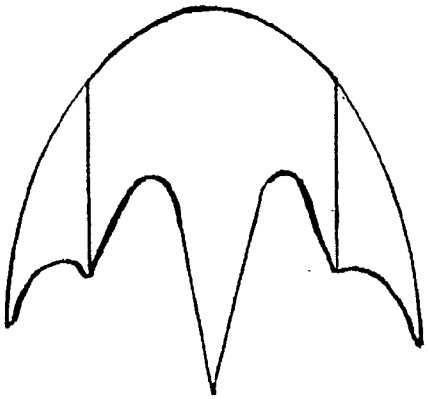
FIG. 4

VARIABLE GEOMETRY KITE

This invention relates to a controllable kite-like flying device, in particular, a device having variable geometry, aerodynamic form, and stability characteristics that may be varied in flight through the use of multiple control-lines.

BACKGROUND OF THE INVENTION

Controllable kites may have one, two, three, four or more control strings, or control lines.

Single string kites of the genre known as Fighting Kites, made and used in India and the Far East for hundreds of years, made usually from tissue paper and split bamboo, are small cheap and expendable. They use the instability of a flat plane, and the stability given to that flat plane when pressure is applied through the bridle, string and airflow, to form a stable vee shape. Held at a constant angle by the bridle, the kite is driven forwards in the direction the kite is facing at the time pressure is applied. When pressure on the string is released, the kite once more returns to a flat plane, becomes directionally unstable, and turns until pressure is once more applied.

Kites controlled by two lines generally have a rigid frame, the aerodynamic form being determined by the way in which the sail is attached to the frame. They can only move in a forward direction, relative to the airflow over them, right and left turns being controlled by the lengthening and shortening of the control lines, generally attached to the kite's bridle.

Kites controlled by three and more control lines (multiple control-lines) can be made to fly in any direction: forwards, backwards, or sideways and can be made to hover and spin on their axis at the command of the control lines. Each line length, on a multiple control line kite, can be adjusted relative to another whilst the kite is in flight. The flyer can, thus, change the angle of the airflow over the whole, or part, of the kite. This allows total control over the kite's attitude, direction and speed.

All previously known multi-string kites, with the exception of those derived from a ram-inflated airfoil shape, have had a relatively rigid frame that predetermines the shape and the aerodynamic form, prior to flight. This rigid frame may be a complex shape, with the sail stretched tightly over it, conforming to that frame shape, or it may be a rigid frame with the kite sail attached loosely, the cut of the sail and the billow of the sail under the pressure of the wind producing a stable aerodynamic shape.

Ram-inflated airfoil designs, whilst non-rigid when uninflated, rely on positive air pressure during flight to produce a shape that is semi-rigid and unable to vary its geometry or intrinsic stability and flying characteristics. Moreover, because of the need for positive air pressure to remain inflated, these designs have limited manoeuvrability and reverse-flight capability.

Also, previously known multi-string kites have generally required a complex system of bridle rigging strings and, in some instances, complicated control handles to provide adequate flying characteristics. These bridling strings are often complex and generally require minute and frequent adjustment to maintain kite performance under differing conditions. This adjustment is generally difficult to achieve and time-consuming.

Current multi-string controllable kites are limited by the rigidity of their design. The designer must choose to produce either an aerodynamic form with low stability suitable for maximum manoeuvrability at low forward speeds or an aerodynamic form suitable for high speed use with high stability and good acceleration. Current designs must, therefore, compromise one or both ends of aerodynamic performance and so fail to provide the optimum performance for the kite flyer.

U.S. Pat. No. 4,892,272 discloses a kite with four control lines and a leading edge support member to which are freely attached wing struts, one at each side thereof. A bridling arrangement is employed to correct the control lines to the support member and the wing struts.

SUMMARY OF THE INVENTION

The present invention seeks to provide a high performance kite-like flying device with a non-rigid frame that provides a variable geometry and aerodynamic form in flight, so achieving minimum stability and, thus, maximum manoeuvrability at low forward or backward speed, and a deep stable profile, to provide maximum stability and acceleration at high forward speed.

The present invention also seeks to allow the maximum range of manoeuvres required by the modern kite flyer over the largest possible range of kite speed.

The present invention also seeks to eliminate the need for a system of bridling strings or complex control handles that may require fine adjustment and, in this way, to provide a device which is simple, easy to set-up and use and is reliable in operation without need for continuous adjustment of equipment.

The present invention further seeks to provide a kite-like flying device which is easy to operate, simple to manufacture and reliable in use.

Accordingly a first aspect of the invention provides a variable geometry kite comprising a frame structure, a sail fitted on said frame structure, and a plurality of lines connected to said frame structure for the control thereof, the frame structure comprising a main spar member of flexible material and left and right spar members respectively attached to the left and right sides of said main spar member, said control lines being attached to said left and right spar members, wherein said left and right spar members are attached to said main spar member by respective left and right joint elements, said joint elements having the characteristic of providing resistance to relative movement of the left and right spar members to the main spar member.

Accordingly a second aspect of the invention provides a variable geometry kite comprising a frame structure, a sail fitted on said frame structure, and a plurality of lines connected to said frame structure for the control thereof, the frame structure comprising a main spar member of flexible material and left and right spar members respectively attached to the left and right sides of said main spar member, said control lines being attached to said left and right spar members, wherein said left and right spar members are attached to said main spar member by respective left and right joint elements, each said joint element having a first end fixedly attached to the main spar member, a second end fixedly attached to the respective left or right spar member, and an intermediate region permitting pivoting of the respective left or right spar member relative to the adjacent part of the main spar member.

Accordingly a third aspect of the invention provides a variable geometry kite comprising a frame structure, a sail fitted on said frame structure, and a plurality of lines connected to said frame structure for the control thereof, the frame structure comprising a main spar member of flexible material and left and right spar members respectively attached to the left and right sides of said main spar member, said control lines being attached to said left and right spar members, wherein said left and right spar members are attached to said main spar member by respective left and right joint elements, and wherein said control lines are connected to said left and right spar members by means of first, second, third and fourth control line fittings, the arrangement being such that said control line fittings extend through respective openings in said sail, whereby said control lines overlie one major surface of said sail and said left and right spar members overlie the other major surface of said sail and whereby movements of said left and right spar members and said sail are correlated.

BRIEF DESCRIPTION OF THE DRAWINGS

A preferred embodiment of the present invention will now be described, by way of example only, with reference to the accompanying drawings, of which:

FIG. 1 shows, for the purpose of comparison, an example of a prior art variable geometry aircraft at slow speed.

FIG. 2 shows, for the purpose of comparison, an example of a prior art variable geometry aircraft high-speed.

FIG. 3 shows a kite in accordance with the present invention at slow speed.

FIG. 4 shows the kite at high speed.

DESCRIPTION OF THE PREFERRED EMBODIMENT

In accordance with the present invention the elasticity of the frame is arranged such that the geometry of this kite changes as the airflow about it increases and decreases. At the same time the aerodynamic form and stability of the kite also change. This variable geometry is similar to that found in modern variable geometry military jet aircraft. As illustrated in FIGS. 1 and 3, at low speed the wings are swept forward so as to present the greatest length of leading edge of the wing at right angles to the airflow over them, creating maximum lift at that airspeed. Then as the airspeed is increased, as illustrated in FIGS. 2 and 4, the wings are swept backwards presenting less frontal area to relative airflow, decreasing drag, but, due to the increased airspeed, lift is maintained or increased.

Figure 19:
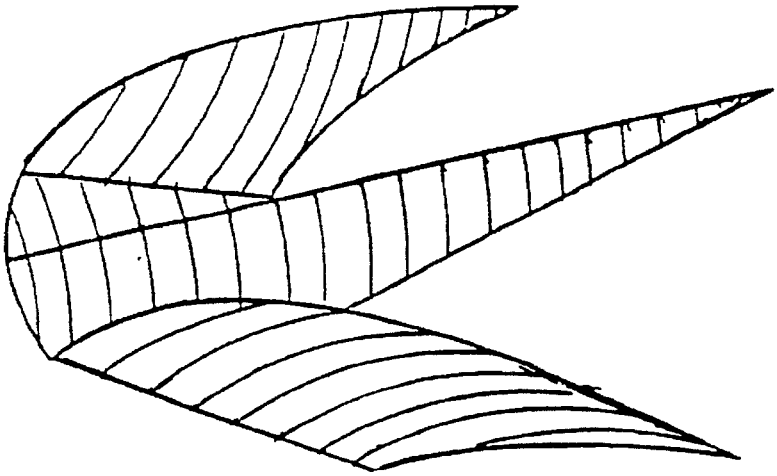
FIG. 19 shows a rear three-quarters view of the kite during high speed flight.
Figure 20:
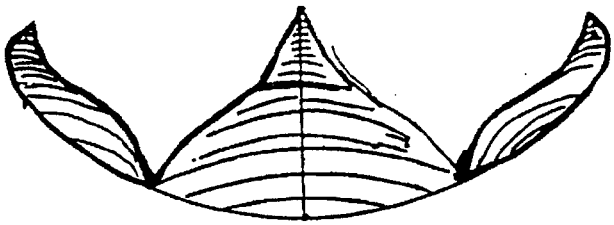
FIG. 20 shows a head-on view of the kite during high speed flight.
Figure 21:
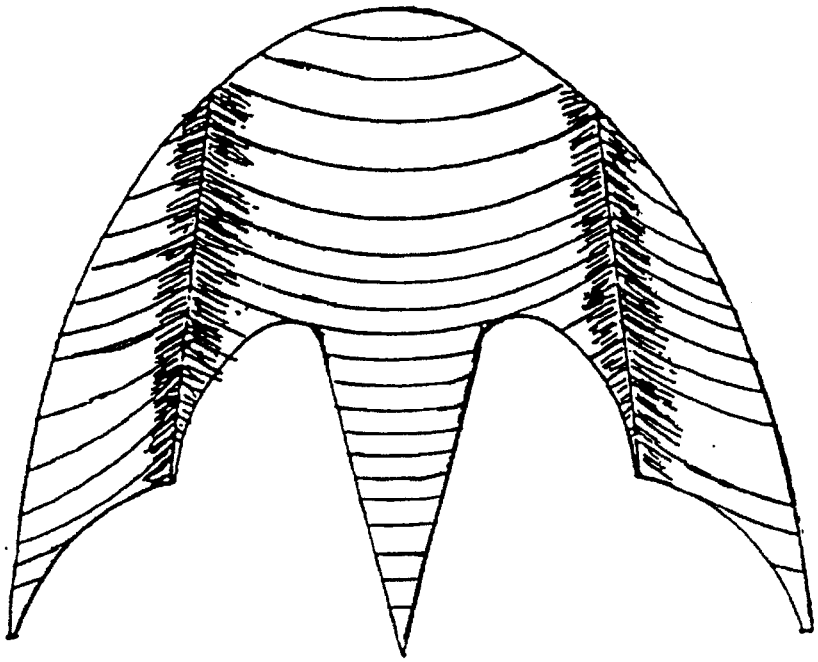
FIG. 21 shows a plan view of the kite during high speed flight.

At rest, the kite is a taut, flat sheet the outline of which is determined by the sprung frame and the cut of the sail. Seen from head-on its form would be a straight line and would have no aerodynamic shape or directional stability. On the other hand at speed, and under pressure from the wind, the kite adopts a shape determined by the flexibility of the leading edge spar and the fulcrum action of the control longerons. This produces a highly stable aerodynamic form in the sail which is capable of high speed and excellent control and handling characteristics. The form of this kite at speed is illustrated in FIGS. 19–21.

In the preferred embodiment, the control lines are attached directly to the frame of the kite, and not via a complex system of bridling, as previously necessary, thus producing very precise control response. In addition, dispensing with bridling lines reduces the complexity and cost of producing the kite and reduces drag, allowing higher speeds to be achieved.

Referring now to the remaining drawings, the kite consists of four basic requirements:

1. A frame of the proportions set out in FIG. 5, made preferably from carbon fibre tube but alternatively of glass re-enforced plastic (GRP) or a combination of both, with attachments of plastic tube and connectors of brass, steel or aluminium alloy;
2. A sail of the proportions set out in FIG. 6, made from lightweight ripstop nylon spinnaker fabric, with reinforcements of heavier material for strength, and with pockets for spars, and brass eyelets for control line access;
3. Four control lines of a suitable non-stretch material; the recommended length of these lines is approximately 100 ft long and of about 150 lb breaking strain;
4. Two control handles which may be of fixed length, FIG. 16, or adjustable, as illustrated in FIGS. 17–18, so as to adjust the rate of control.

Although the kite may be made to various sizes, the kite here described is for a main spar of 3 m 50 cm in length, with two control longerons 2 60–70 cm long and a centre stiffener 3 of 1 m 22 cm in length and is made with a carbon fibre tube.

Figure 5:
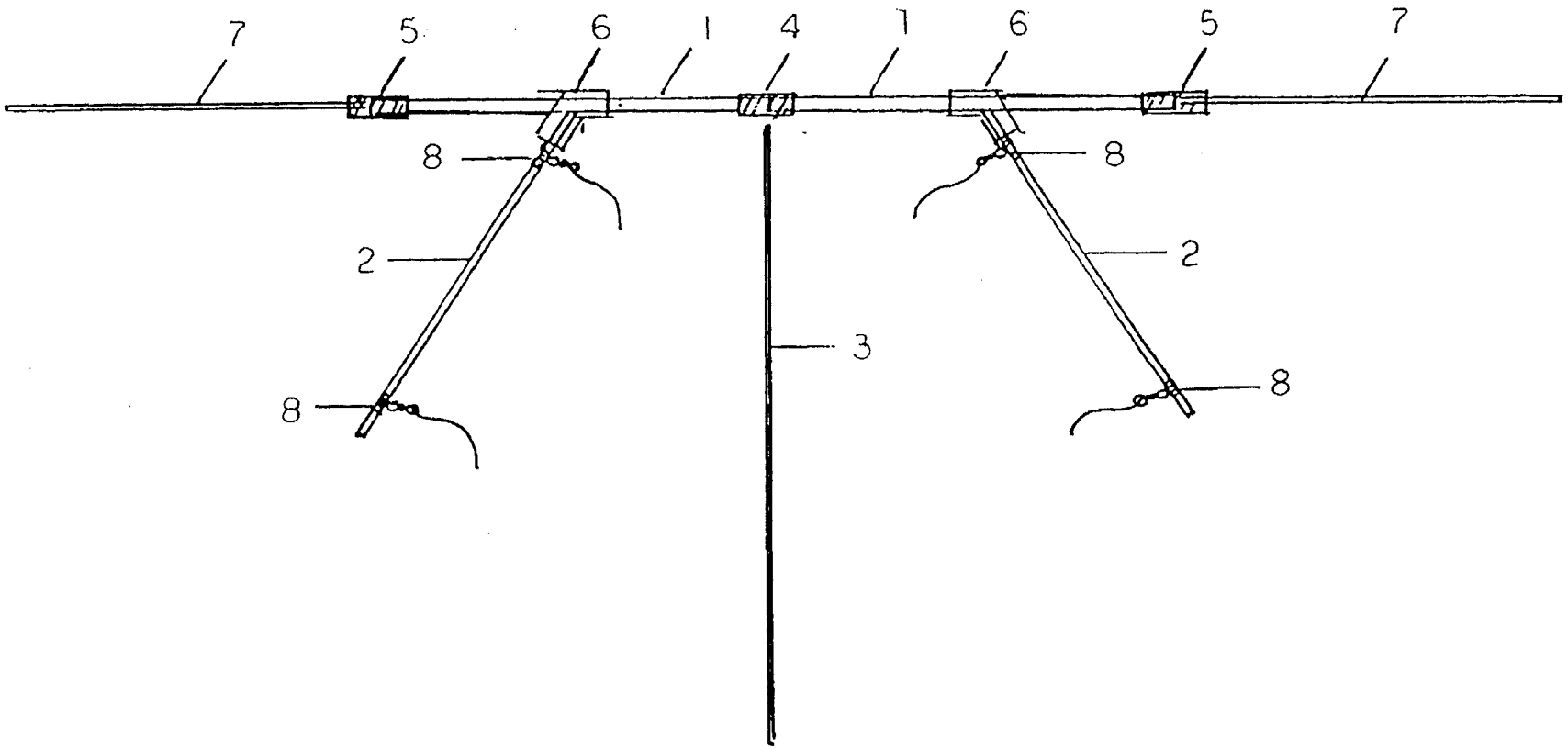
FIG. 5 shows static frame layout and components.

As illustrated in FIG. 5, the main spar may be made up, for convenient handling, in four separate pieces of carbon fibre material; two centre tubular sections 1, each 75 cm long×5.5 mm dia and two outer solid sections 7, each 100 cm long×5 mm dia. The two outer pieces 7 may preferably be made in a taper fashion, but this is not a pre-requisite, due to the difficulty of obtaining tapered sections.

Figure 8:
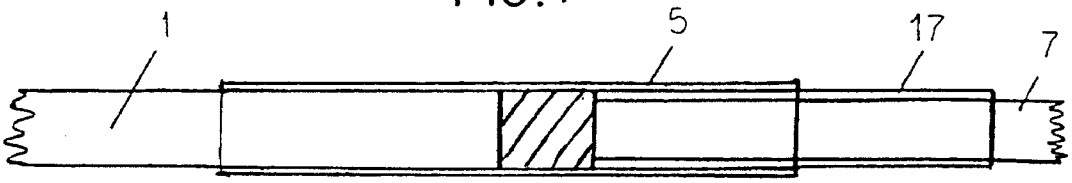
FIG. 8 shows detail of outer spar joint.

The two centre sections 1 are joined together via brass or steel ferule 4 of 5.5 mm internal dia, the ferule 4 being permanently glued to one side, the other being made a close sliding fit. Similarly, the two outer carbon fibre pieces 7 are connected to centre section 1 via a brass or steel ferule 5, glued permanently to section 1. A sliding fit of section 7 is accomplished by sleeving section 7 with a suitable piece of brass tube 17, as detailed in FIG. 8.

Left and right spar members 2 in the form of two control longerons 2 are also preferably carbon fibre tube. A diameter of 5.5 mm to 6.3 mm, to a length of 50 to 70 cm will provide sufficient stiffness. GRP can be used, but would have to have a greater diameter for the same stiffness. Stiffness along the control longeron is very important, as insufficient stiffness here changes the control and handling characteristics, and has a detrimental effect upon the speed of the kite.

Figure 9:
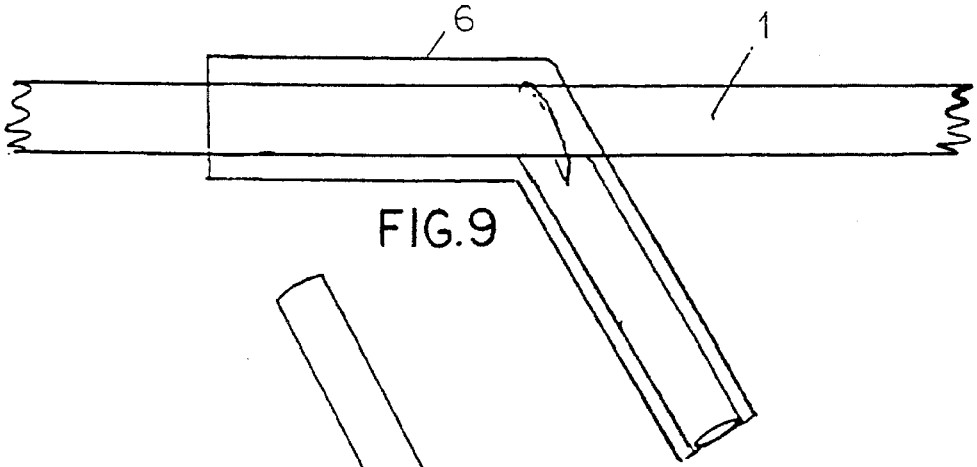
FIG. 9 illustrates the fitting used to attach the control longerons to the main spar.

The control longerons 2 are each connected to the main spar 1 via a socket made from plastic tube 6, 6 cm long, having an internal diameter of 5.5 mm, and an outside diameter of 13 mm. A hole is cut in one wall of this piece of tube 6, approximately 5.5 mm long, halfway along its length. This tube 6 is now forced onto the main spar 1, and positioned 30 cm from the centre ferule, as shown in FIG. 5, and detailed in FIG. 9. Thus one end of each tube 6 is secured against movement relative to the main spar 1, and the other end is secured against movement relative to the respective longeron 2.

The material of tube 6 may be characterised as semi-rigid or semi-flexible. Although it has a certain resistance to bending, it does permit pivoted movement of the longerons 2 in response to the forces arising in flight. It is a requirement that this joint allow the respective control longeron to act as a fulcrum on the leading edge spar to achieve proper control of the variable geometry form. In other words, even as the geometry of the kite changes in flight, the degree of rigidity of the socket tube 6 ensures that the longeron 2 remains at a controlled angle to the immediately adjacent portion of the main spar 1, so that forces on the lines of the kite in conjunction with prevailing wind forces on the sail, enable the curvature of the main spar 1, 7 to be precisely controlled.

Figure 10:
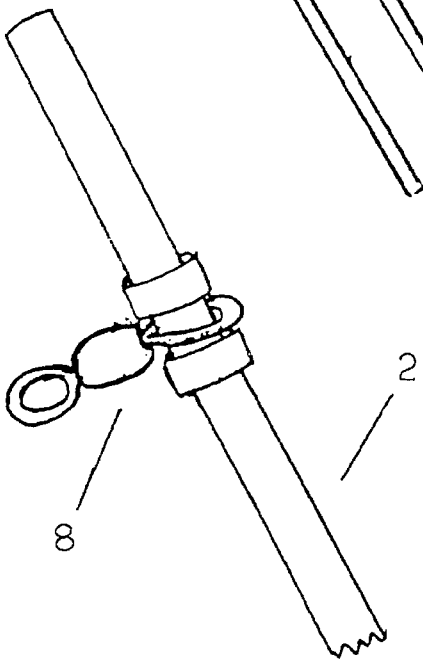
FIG. 10 shows the attachment of the swivels to the control longerons.

The control line fittings 8 comprise four 250 lb breaking strain fishing swivels, one end of the swivel is enlarged so as to slide on to the control longeron 2 and positioned at the points indicated in FIG. 5 with the aid of small pieces of plastic tube that fit tightly on the control longeron and are positioned one either side of the swivel FIG. 10. Spar 3 in FIG. 5 is a piece of carbon fibre tube 5 mm in diameter and some 1 m 22 cm in length. It is not attached to the frame but fits into pockets in the sail, where it acts as an optional sail stiffener. Alternatively, at the junction with the main spar 1, spar 3 may be attached thereto by means of a moulded rubber T-piece.

Figure 6:
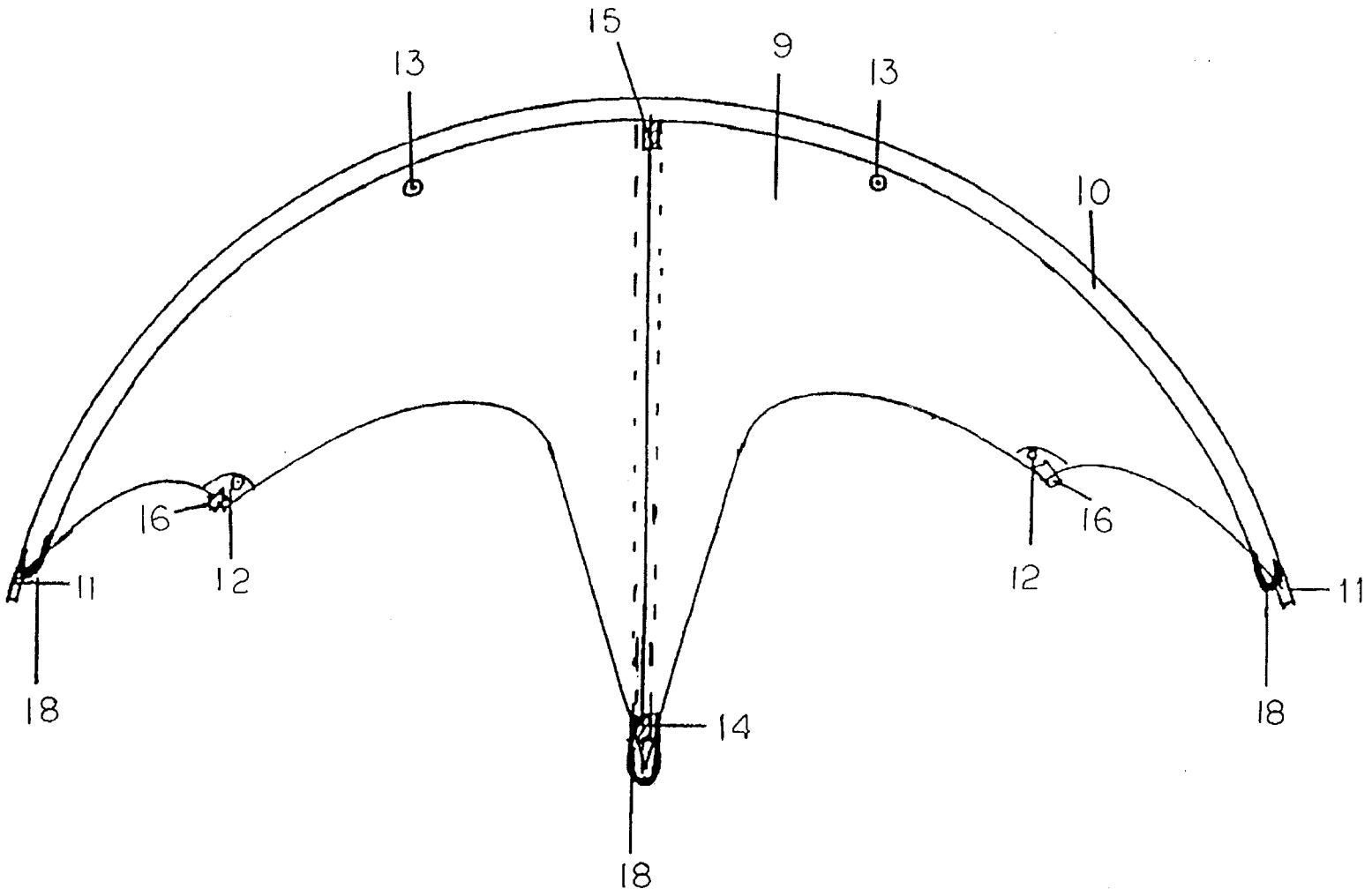
FIG. 6 shows static sail shape and layout of fittings.
Figure 7:
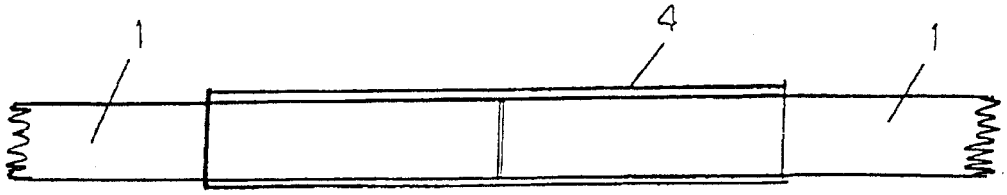
FIG. 7 shows detail of centre spar joint.
Figure 11:
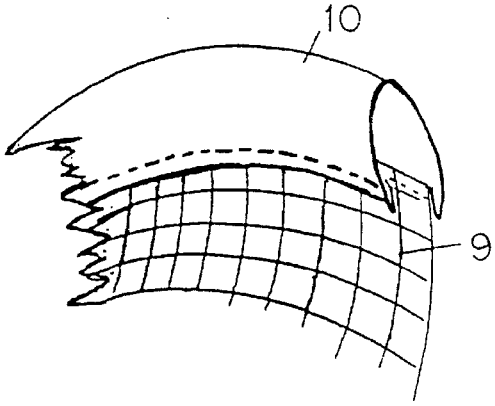
FIG. 11 illustrates the pocket used to attach the main spar to the sail.

To make the sail, using the sail diagram FIG. 6, cut a piece, or several pieces, of lightweight ripstop nylon, so that when they have been joined together a single piece conforming to the shape of FIG. 6 will result, having a curved leading edge with a radius of 1 m 22 cm, a total length of leading edge of 3 m 20 cm, and length measured along the centreline from 14 to 15 of 1 m 22 cm. At the centre line of the sail form a pocket 2 cm wide into which the centre sail stiffening spar 3 will fit when the kite is assembled. To the front curved edge, make up a pocket 10 from somewhat stronger proofed material, from a piece 3 m 50 cm long by 12 cm wide, so that it creates a pocket or sleeve, as shown in FIG. 11 some 5 cm deep along the leading edge, that will contain the main spar 1,7. Hem the trailing edge of the sail 9 with a proofed non-stretch material 10 mm wide.

Figure 12:
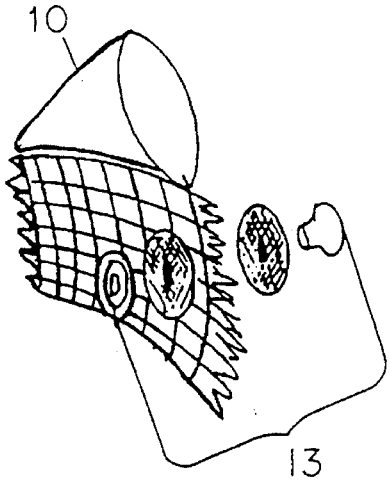
FIG. 12 illustrates the attachment of the eyelet onto the sail.
Figure 13:
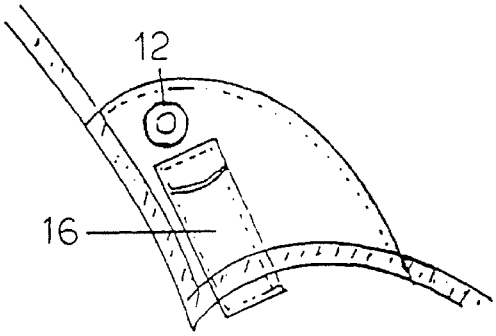
FIG. 13 shows the pocket designed to hold the control longeron and the eyelet in exploded form for the control line.

A affix a No 22 brass eyelet 13 using a small disc of reinforcing material on either side of the sail, as detailed in FIG. 12 (exploded-view).

Through the corner re-enforcing material, affix a No 22 brass eyelet 12 and add a pocket of nylon webbing 16, 25×50 mm, to take the bottom end of the control longeron 2.

At the leading edge adjacent to the eyelet 13, remove 10 cm of the stitching on the rear side of the sail, the socket 6 for the control longeron 2 is then accessible.

Figure 14:
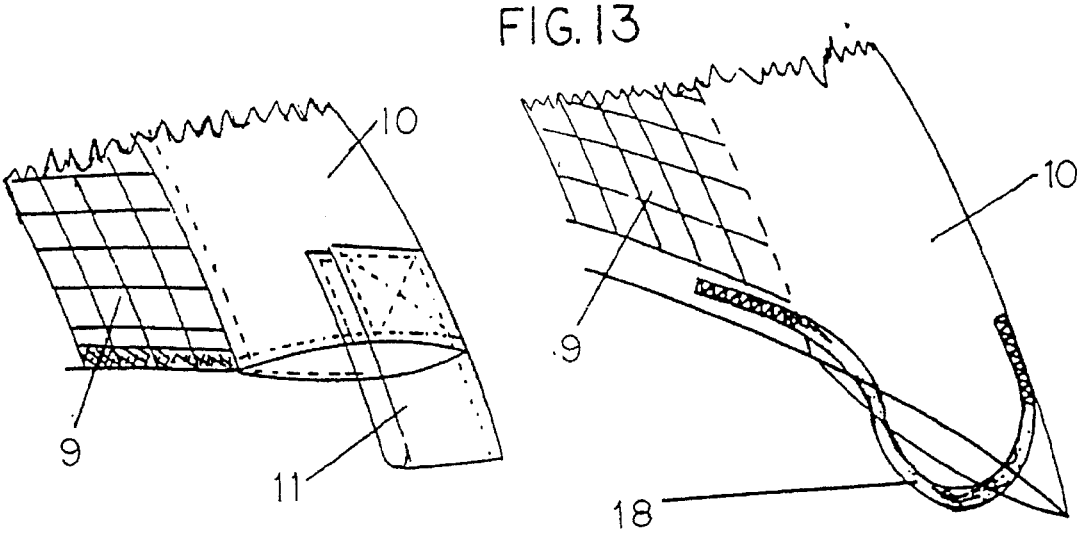
FIG. 14 shows the end pocket that holds the main spar in the leading edge pocket and also the alternative method using elastic shock cord.

Cut the leading edge pocket 10 at 11 to conform to the sail shape, and form a pocket from nylon webbing to take the end of the main spar 1,7, and set into the end of the leading edge pocket, leaving a small gap on the inside edge for the fitting of the outer piece of the main spar 7 or attach a piece of elasticated shock cord FIG. 14/18 to retain the main spar in place.

At the centre position 15, remove 10 cm of stitching from the rear side of the leading edge pocket, in order to facilitate the assembly of the sail and main spar.

To assemble the kite, insert the two centre sections 1 of the main spar into the leading edge pocket 10 of the sail 9 at the access gap at position 15, and join the two pieces 1 at position 15 with the brass ferule 4.

Insert the two outer sections 7 of the main spar into the leading edge pocket, at the access point adjacent to the tip of the sail 9, and locate it into the socket 5 at the end of the centre section of the main spar 1.

Pull the sail 9 towards the ends of the main spar 7 and locate the ends 7 of the main spar in the pockets 11 at the tips of the leading edge pocket 10 or locate the knocks of spar 7 into the elasticated shock cord at position 11. A knock is a plastic end fitting having a groove therein. When both ends are located, the main spar will be curved and under modest tension.

The control line longerons 2 may now be positioned. Locate one end into the pocket 16 and the other end into the socket 6 on the main spar 1 at position 13. They should be a tight fit and, when both are in position, make the sail taught.

The control line fittings 8 should now be moved so that they line up with the brass eyelets 12 and 13, and protrude through the brass eyelets to the front side of the sail so that the control lines may be attached to them.

Figure 15A:
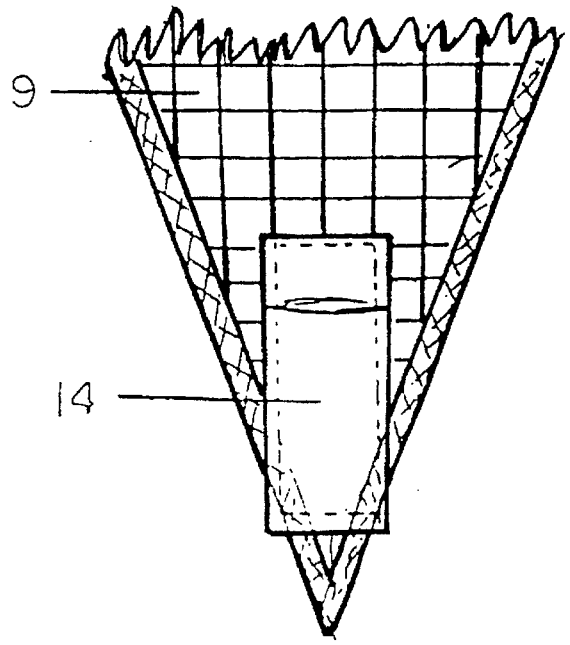
FIG. 15A shows the pocket that holds the end of the optional sail stiffener.
Figure 15B:
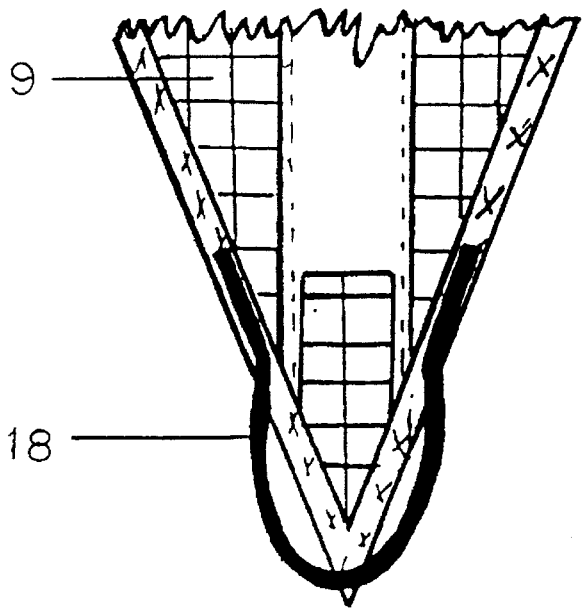
FIG. 15B shows a modification using elastic shock cord.

Locate the sail stiffener 3 in the pocket at the centre of the sail the top end fitting into a vinyl socket on the main spar the bottom end held under tension by the elastic shock cord 18 or use alternately the pockets 15 & 14 as in FIG. 15A and 15B. The kite assembly is now complete.

Figure 16:
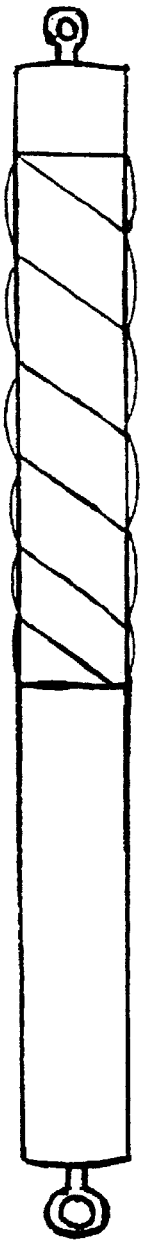
FIG. 16 shows a fixed length control handle.
Figure 17:
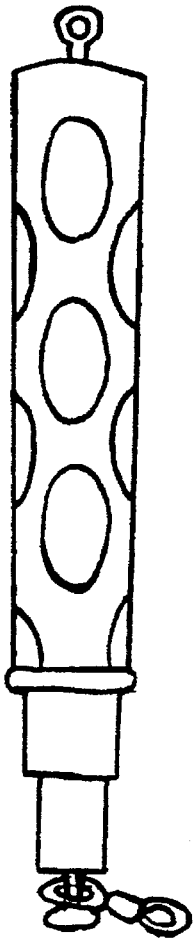
FIG. 17 shows a modification in the form of a variable length control handle at its shortest (least sensitive) position.
Figure 18:
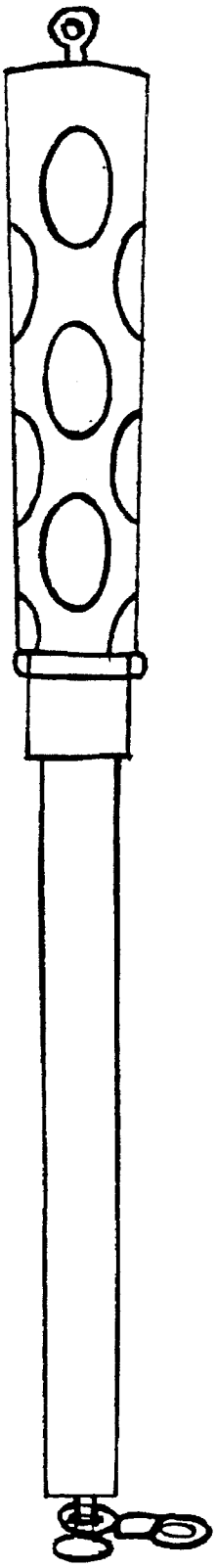
FIG. 18 shows the control handle of FIG. 17 at its longest (most sensitive) position.

Attach, with a suitable clip, a non-stretch line to each of the control line fittings 8 of equal length (typically 30 m) and then to a pair of control handles as shown in FIG. 16–18 and described below, and the kite is ready to fly.

The fixed control handle, shown in FIG. 16 may be made of wood or metal 25 cm long, with a steel screw eye at both ends to which the control lines are attached.

Preferably the handle should be made as shown in FIGS. 17–18, so that the length is variable between 20 cm and 30 cm long, by means of an internal locking and unlocking cam mechanism. This achieves much more precise control of the kite, since the relationship between the distance the control fittings on the control longerons are apart, and the distance that the control lines are apart at the handles, determines the control sensitivity of the kite.

It should be noted that, in the above-designed preferred embodiment, the angle and position of the control longerons relative to the centre line of the kite are important, as it is this angle and position, together with the elasticity of the main spar, that controls the variable geometry of the kite, and it is the variable geometry that produces the aerodynamic form of the kite, which allows it to fly well and respond to the control handles.

The three-dimensional shape of the kite in flight is determined not only by the curvature of the main spar 1 but also by the fact that the passage of the four control fittings 8 through said eyelets 12 and 13 provide four points at which the sail is constrained to move with the longerons 2. The distance of the free end of each longeron 2 from the free end of the adjacent main spar section 7 is maintained substantially constant when the sail is attached.

In kites according to the present invention there is no direct connection between the control lines and the main spar 1; all the control forces are introduced via the control longerons 2 and their associated sockets or joint elements 6.

It is preferred that the toe-in angle of the control longerons relative to the centre-line when the kite is assembled as in FIG. 5 but not in flight is not less than 10 degrees and not more than 40 degrees.

When the kite is in flight the wind forces on the sail cause the kite to adopt a three-dimensional configuration as show in FIGS. 19 to 21 and the longerons 2 pivot inwardly towards the centre line of the kite. The longerons can become parallel to the centre line, but pivoting beyond this position is strongly resisted by air pressure which has the advantages of providing a self-regulating and stable configuration and preventing breakage of the main spar member 1. Outwards pivoting of the longerons is prevented by the sail.

As the kite increases speed, longerons 2 pivot inwardly towards the centre line, the ends of main spar sections 7 also bend inwardly (due to the sail 9) and so tubes 6 will bend by an amount which is determined by, inter alia, the curvature of the main spar 1 between its free ends and the respective tubes 6.

Tension must be kept on all four control lines when flying, but not equal pressure on all four lines, except when hovering the kite. When flying in a forward direction, greater pressure is applied to the top two, or leading, lines than the trailing, or bottom, lines and vice-versa when flying backwards.

The shape of the trailing edge of the kite may be varied to taste and aesthetic inclination, so long as the ensuing shape conforms to the constraints and specifications set out previously, with regard to the length and toe-in limits of the control line longerons.

If desired tubes 6 may be of a relatively tough rubber material. Also, the sail may have a venting slot provided 30–40 cm from the tip of the sail to control the wing tip oscillation that can occur at high speed.

It will be understood that the above description of the present invention is susceptible to various modifications, changes and adaptations.

What is claimed is:

1. A variable geometry kite, which comprises:

a) a frame structure comprised of a flexible material and having a main spar member to form a continuous flexible leading edge for the frame structure, the flexible material arranged and constructed to permit the main spar member to move between a static, non-flight straight position of greatest length and a swept-back, in-flight, curved position in use;

b) left and right spar members, each having a one and other end and respectively attached at the one end to the left and right ends of the main spar member to act as control longerons;

c) semi-rigid joint elements to attach the one end of the respective left and right spar members to the main spar member, the joint elements arranged and constructed to permit pivoted resistive selective movement of the left and right spar members in relation to the main spar member in response to forces occurring in flight and to maintain the left and right spar members at a generally controlled angle to the immediate adjacent section of the main spar member;

d) multiple control line means to include a control line being attached to the left spar member and a control line attached to the right spar member to control and to correlate the movements of the left and right spar members by a kite user; and e) a sail in a selected sail shape and fitted onto said frame structure.

2. A kite according to claim 1 wherein the control line means comprises first, second, third and fourth control lines, said first control line being directly connected to said left spar member adjacent to said left joint element, said second control line being directly connected to said left spar member remote from said left joint element, said third control line being directly connected to said right spar member adjacent to said right joint element, and said fourth control line being directly connected to said right spar member remote from said right joint element.

3. A kite according to claim 1 wherein said joint elements each comprise a length of plastic tube having a wall with a hole in the wall thereof, said main spar member passing through one end of said tube and through said hole, and a one end of a respective left spar member or right spar member engaging in the other end of said tube.

4. A kite according to claim 1 which includes a sail spar stiffener member, said sail spar stiffener member not being directly connected to said frame structure, said sail including pocket means, and said sail spar stiffener member being arranged to be located in said pocket means thereby to stiffen said sail.

5. A kite according to claim 4 wherein said sail said spar stiffener member defines a centre line of the kite generally perpendicular to the main spar member and, when the kite is assembled but not in flight, the left and right spar members lie at an angle in the range of 10° to 40° to said centre line.

6. A kite according to claim 1 wherein the sail is characterized by a sail pocket, and which includes a carbon fiber material tubular sail stiffener spar extending generally perpendicular from the main spar member and not connected to said frame structure, and which stiffener spar fits into and engages said sail pocket.

7. A kite according to claim 1 wherein the left and right spar members extend from a centre line and lie at an angle in the range of 10° to 40° from said centre line.

8. A kite according to claim 1 wherein the flexible material of the frame structure is selected from the group consisting of carbon fiber material, and glass reinforced plastic material.

9. A kite according to claim 1 wherein the kite includes a main spar member comprised of a plurality of adjoining, generally straight left and right sections to form a substantially straight continuous leading edge of said attached sections, when the kite is in a static condition.

10. A kite according to claim 9 wherein the main spar member includes two central tubular sections and two outer solid sections secured to the one end respectively of the central tubular sections.

11. A kite according to claim 1 wherein the sail material comprises a ripstop nylon sail material, characterized by a plurality of pockets to retain the sail to the frame structure.

12. A kite according to claim 1 wherein said left and right joint elements include a semi-flexible, intermediate region to permit selected pivoting movement of said left spar member and right spar member responsive to the control line means.

13. A kite according to claim 2 which includes a first and second control handle, said first and second control lines being connected to said first control handle and said third and fourth control lines being connected to said second control handle.

14. A kite according to claim 3 wherein said control handles are of adjustable length.

15. A kite according to claim 2 wherein said sail has first and second major surfaces and wherein said first, second, third and fourth control lines are connected to said left and right spar members by means of respective control line fittings in said sail, said control line fittings extending through respective openings in said sail, whereby said control lines overlie a first major surface of said sail and said left and right spar members overlie a second major surface of said sail, and whereby movements in flight of said left and right spar members and said sail are correlated.

16. A kite according to claim 1, wherein the left and right spar members are comprised of carbon fiber material, and have a length of about 50 to 70 cm and a diameter of about 5.5 to 6.3 mm.

17. A kite according to claim 1 which includes a single adjustable handle means secured to the control line means.

18. A kite according to claim 4 wherein the sail material includes a fitting socket on the main spar member to receive a one top end of the sail spar stiffener member and a shock cord to retain the main spar at the other bottom end of the spar stiffener member under tension.

19. A kite according to claim 1 wherein the frame structure, viewed from a head-on static position, comprises substantially a straight line.

20. A variable geometry kite comprising:

a) a frame structure;

b) a sail fitted on said frame structure;

c) a plurality of control lines connected to said frame structure for the control thereof;

d) the frame structure comprising a main spar member of flexible material and having a continuous leading edge, said main spar member to form a continuous flexible leading edge for the frame structure in the static position, the flexible material arranged and constructed to permit the main spar member to move between a static, non-flight straight position of greatest length and a curved, in-flight, swept-back position in use, and left and right spar members are respectively attached to the left and right sides of said main spar member;

e) said control lines being attached to said left and right spar members, wherein said left and right spar members are attached to said main spar member only at a one end by respective left and right joint elements; and f) each said joint element having a first end fixedly attached to the main spar member, a second end fixedly attached to the respective left or right spar member, and an intermediate region permitting pivoting of the respective left or right spar member relative to the main spar member.

21. A variable geometry kite, comprising:

a) a frame structure;

b) a sail fitted on said frame structure;

c) a plurality of lines connected to said frame structure for the control thereof;

d) said frame structure comprising a main spar member having a continuous leading edge of flexible material, and having a main spar member to form a continuous flexible leading edge for the frame structure in the static position, the flexible material arranged and constructed to permit the main spar member to move between a static, non-flight straight position of greatest length and a swept-back, in-flight, curved position in use, and left and right spar members respectively attached to the left and right sides of said main spar member;

e) said control lines being attached to said left and right spar members, wherein said left and right spar members are semi-rigidly attached at a control angle at one end to said continuous leading edge main spar member by respective left and right joint elements;

f) wherein said control lines are connected to said left and right spar members by means of first, second, third and fourth control line fittings, the arrangement being such that said control line fittings extend through respective openings in said sail, whereby said control lines overlie one major surface of said sail and said left and right spar members overlie the other major surface of said sail; and g) an adjustable length handle means connected to the control lines, whereby movements of said left and right spar members and said sail are correlated.

* * * * *

UNITED STATES PATENT AND TRADEMARK OFFICE

CERTIFICATE OF CORRECTION

PATENT NO. : 5,556,057

DATED : September 17, 1996

INVENTOR(S) : David V. Davies

It is certified that error appears in the above-indentified patent and that said Letters Patent is hereby corrected as shown below:

Column 8, line 32, claim 5, delete second "said".

Column 9, line 4, claim 14, delete "3" and insert --13--.

Signed and Sealed this

Twenty-fourth Day of December, 1996

*Attest:*

Bruce Lehman

BRUCE LEHMAN

*Attesting Officer*

*Commissioner of Patents and Trademarks*